US005691128A

United States Patent [19]

Ohzeki et al.

[11] Patent Number: 5,691,128

[45] Date of Patent: Nov. 25, 1997

[54] METHODS FOR PRODUCING PHOTOGRAPHIC SILVER HALIDE EMULSIONS

[75] Inventors: Katsuhisa Ohzeki, Minami-ashigara, Japan; Yuji Yoshida, deceased, late of Minami-ashigara, Japan, by Hideno Yoshida, Mutsumi Yoshida, Hitomi Yoshida, legal heirs/representatives

[73] Assignee: Fuji Photo Film Co., Ltd., Kanagawa, Japan

[21] Appl. No.: 709,030

[22] Filed: Sep. 6, 1996

[30] Foreign Application Priority Data

Sep. 8, 1995 [JP] Japan ..... 7-230906

[51] Int. Cl.[6] ..... G03C 1/07; G03C 1/035

[52] U.S. Cl. ..... 430/569; 430/600; 430/613

[58] Field of Search ..... 430/569, 600, 430/613

[56] References Cited

U.S. PATENT DOCUMENTS 4,983,508 1/1991 Ishiguro et al. ..... 430/569

5,260,183 11/1993 Ishiguro et al. ..... 430/567

FOREIGN PATENT DOCUMENTS 0723187 7/1996 European Pat. Off. ..... G03C 1/07

4-6546 1/1992 Japan ..... G03C 1/035

5-53231 3/1993 Japan ..... G03C 1/035

*Primary Examiner*—Mark F. Huff

*Attorney, Agent, or Firm*—Sughrue, Mion, Zinn, Macpeak & Seas, PLLC

[57] ABSTRACT

A method for producing a silver halide emulsion having a silver chloride content of 50 mol % or more and containing silver halide grains in which (111) faces occupy 30% or more of their surface area, wherein said silver halide grains are formed in the presence of a pyridinium salt crystal habit modifier, and a thiocyanate and a sensitizing dye are added prior to a washing step of emulsion production, thereby removing the crystal habit modifier out of the emulsion to eliminate the side effect caused thereby and to improve photographic characteristics.

8 Claims, No Drawings

METHODS FOR PRODUCING PHOTOGRAPHIC SILVER HALIDE EMULSIONS

FIELD OF THE INVENTION

The present invention relates to methods for producing photographic silver halide emulsions, and particularly to improvements in spectral sensitization techniques of tetradecahedral, octahedral or tabular grains having (111) faces, said grains being composed of silver chloride, or silver chlorobromide, silver chloroiodide or silver chloroiodobromide having a high silver chloride content.

BACKGROUND OF THE INVENTION

It is now needed that the development time and the fixing time can be shortened, as the performance of silver halide photographic materials, and for this purpose, silver chloride grains are noted. Silver chloride grains or grains high in silver chloride content (which mean grains having a silver chloride content of 50% or more, and which are hereinafter referred to as "high silver chloride grains") are materials well-known in the art, and are practically used in photographic materials for graphic arts printing and photographic materials for printing paper.

The high silver chloride grains are apt to be formed as grains having (100) faces on outer surfaces (hereinafter referred as to "(100) type grains") under conventional production conditions, and the grains practically used are cubic. In contrast, for silver iodobromide grains, grains mainly having (111) faces on outer surfaces (hereinafter referred to as "(111) type grains") can be easily produced, and the (111) type silver iodobromide grains are most frequently used in photographic materials for general photographing. In particular, the (111) type grains are easily formed in the tabular form, and it is possible to increase their specific area (the ratio of surface area to volume). Accordingly, they have advantages that they can be effectively subjected to spectral sensitization, and that they have high covering power after development. Also for the high silver chloride grains, therefore, it has been demanded to produce the (111) type grains.

Special means are required for the production of the (111) type high silver chloride grains. Wey discloses a method for producing high silver chloride tabular grains by use of ammonia in U.S. Pat. No. 4,399,215. The use of ammonia for the grains produced by this method further increase the solubility in the production of silver chloride grains having a high solubility, causing difficulty in producing practically useful small-sized grains. Further, the grains have the disadvantage of being liable to generate fog because they are produced at a high pH of 8 to 10. Maskasky discloses (111) type high silver chloride grains produced by use of a thiocyanate in U.S. Pat. No. 5,061,617. The thiocyanate increases the solubility of silver chloride similarly to ammonia.

Methods are known in which additives (crystal habit modifiers) are added in the grain formation in order to form the high silver chloride grains having (111) faces on outer surfaces, as shown below:

| Patent No. | Crystal Habit Modifiers | Inventor |
|---|---|---|
| U.S. Pat. No. 4,440,463 | Azaindenes + Thioether Peptizers | Maskasky |
| U.S. Pat. No. 4,783,399 | Thiazolidine-2,4-dione | Takada |

-continued

| Patent No. | Crystal Habit Modifiers | Inventor |
|---|---|---|
| U.S. Pat. No. 4,713,323 | Aminopyrazolopyrimidine | Maskasky |
| U.S. Pat. No. 4,983,508 | Bispyridinium Salts | Ishiguro |
| U.S. Pat. No. 5,185,239 | Triaminopyrimidine | Maskasky |
| U.S. Pat. No. 5,178,997 | 7-Azaindole Compounds | Maskasky |
| U.S. Pat. No. 5,178,998 | Xanthine | Maskasky |
| JP-A-64-70741 | Dyes | Nishikawa |
| JP-A-3-212639 | Aminothioethers | Ishiguro |
| JP-A-4-283742 | Thiourea Derivatives | Ishiguro |
| JP-A-4-335632 | Triazolium Salts | Ishiguro |
| Japanese Patent Application No. 7-146891 | Monopyridinium Salts | Ohzeki |

The term "JP-A" as used herein means an "unexamined published Japanese patent application".

When the grains are formed using the crystal habit modifiers, said modifiers are known to produce a photographically undesirable side effect such as dye adsorption inhibition. On the other hand, removal of the crystal habit modifiers causes unstable grain form, even after grain formation. U.S. Pat. No. 5,298,387 discloses a method for achieving compatibility between removal of a crystal habit modifier and spectral sensitization by adjusting the pH to desorb the crystal habit modifier, followed by retention of the grain form with a specified dye, in order to remove the side effect of the crystal habit modifier and to stabilize the grain form. In this method, however, restriction of the applicable dye and removal of the crystal habit modifier due to pH-regulation become a burden on the production.

Of the crystal habit modifiers shown above, the pyridinium salts are known to be preferably used as photographic materials because of a small reduction in chromatic sensitization efficiency. These examples are disclosed in Japanese Patent Application No. 7-146891 and JP-A-2-32. However, it is essentially unfavorable that compounds having the property of being adsorbed on silver halide grains, such as the crystal habit modifiers, exist in emulsions. In order to completely adsorb the sensitizing dyes, it has been desired that the crystal habit modifiers are removed-out of the emulsions.

SUMMARY OF THE INVENTION

An object of the present invention is to provide a method for producing an emulsion containing (111) type high silver chloride grains produced by use of a pyridinium salt as a crystal habit modifier, wherein said crystal habit modifier is removed out of the emulsion, thereby removing the side effect caused by the crystal habit modifier and improving photographic characteristics, particularly enhancing spectral sensitization efficiency.

The foregoing and other objects of the present invention can be accomplished by the following method.

(1) a method for producing a silver halide emulsion having a silver chloride content of 50 mol % or more and containing silver halide grains in which (111) faces occupy 30% or more of their surface area, wherein said silver halide grains are formed in the presence of at least one compound selected from the group consisting of compounds represented by formulas (I), (II) and (III), and a thiocyanate and a sensitizing dye are added prior to a washing step of emulsion production:

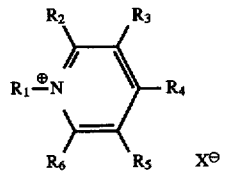

(I)

wherein $R_1$ represents an alkyl group, an alkenyl group or an aralkyl group; $R_2$, $R_3$, $R_4$, $R_5$ and $R_6$ each represents a hydrogen atom or a substituent group; $R_2$ and $R_3$, $R_3$ and $R_4$, $R_4$ and $R_5$and $R_5$ and $R_6$ may each be cyclocondensed, with the proviso that at least one of $R_2$, $R_3$, $R_4$, $R_5$ and $R_6$ represents an aryl group; and $X^-$ represents a counter anion;

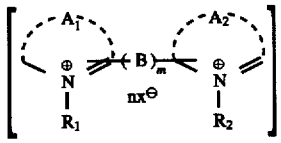

(II)

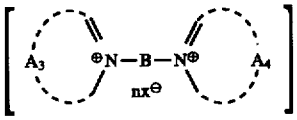

(III)

wherein $A_1$, $A_2$, $A_3$ and $A_4$, which may be the same or different, each represents a nonmetallic atom group for completing a nitrogen-containing heterocyclic ring; B represents a divalent connecting group; m represents 0 or 1; $R_1$ and $R_2$ each represents an alkyl group; X represents an anion; and n represents 0 or 1, and n is 0 in the case of an internal salt; and preferably (2) the method described in the above item (1), wherein desalting is conducted in the washing step using a precipitant containing no sulfonic acid group.

DETAILED DESCRIPTION OF THE INVENTION

The compounds of formula (I) used in the present invention is hereinafter described in detail.

In formula (I), $R_1$ is preferably a straight-chain, branched or cyclic alkyl group having 1 to 20 carbon atoms (for example, methyl, ethyl, isopropyl, t-butyl, n-octyl, n-decyl, n-hexadecyl, cyclopropyl, cyclopentyl or cyclohexyl), an alkenyl group having 2 to 20 carbon atoms (for example, allyl, 2-butenyl or 3-pentenyl) or an aralkyl group having 7 to 20 carbon atoms (for example, benzyl or phenetyl). Each group represented by $R_1$ may be substituted. The substituent groups include substitutable groups (i.e., groups capable of substitution) represented by $R_2$ to $R_6$ shown below.

$R_2$, $R_3$, $R_4$, $R_5$ and $R_6$, which may be the same or different, each represents a hydrogen atom or a substitutable group (i.e., a group capable of substitution). Examples of the substitutable groups include halogen atoms (for example, fluorine, chlorine and bromine), alkyl groups (for example, methyl, ethyl, n-propyl, isopropyl, t-butyl, n-octyl, cyclopentyl and cyclohexyl), alkenyl groups (for example, allyl, 2-butenyl and 3-pentenyl), alkynyl groups (for example, propargyl and 3-pentynyl), aralkyl groups (for example, benzyl and phenetyl), aryl groups (for example, phenyl, naphthyl and 4-methylphenyl), heterocyclic groups (for example, pyridyl, furyl, imidazolyl, piperidyl and morpholino), alkoxyl groups (for example, methoxy, ethoxy and butoxy), aryloxy groups (for example, phenoxy and 2-naphthyloxy), amino groups (for example, unsubstituted amino, dimethylamino, ethylamino and anilino), acylamino groups (for example, acetylamino and benzoylamino), ureido groups (for example, unsubstituted ureido, N-methylureido and N-phenylureido), urethane groups (for example, methoxycarbonylamino and phenoxycarbonylamino), sulfonylamino groups (for example, methylsulfonylamino and phenylsulfonylamino), sulfamoyl groups (for examples, unsubstituted sulfamoyl, N,N-dimethylsulfamoyl and N-phenylsulfamoyl), carbamoyl groups (for example, unsubstituted carbamoyl, N,N-diethylcarbamoyl and N-phenylcarbamoyl), sulfonyl groups (for example, mesyl and tosyl), sulfinyl groups (for example, methylsulfinyl and phenylsulfinyl), alkyloxycarbonyl groups (for example, methoxycarbonyl and ethoxycarbonyl), aryloxy-carbonyl groups (for example, phenoxycarbonyl), acyl groups (for example, acetyl, benzoyl, formyl and pivaloyl), acyloxy groups (for example, acetoxy and benzoyloxy), phosphoric acid amide groups (for example, N,N-diethylphosphoric acid amide), alkylthio groups for example, methylthio and ethylthio), arylthio groups (for example, phenylthio), cyano, sulfo, carboxyl, hydroxyl, phosphono, nitro, sulfino, ammonio groups (for example, trimethylammonio), phosphonio and hydrazino. These groups may be further substituted. When the groups are each substituted by two or more substituent groups, they may be the same or different.

$R_2$ and $R_3$, $R_3$ and $R_4$, $R_4$ and $R_s$ and $R_5$ and $R_6$ may each be cyclocondensed to form a quinoline ring, an isoquinoline ring or an acridine ring.

$X^-$ represents a counter anion. Examples of the counter ions include halogen ions (chlorine and bromine ions), a nitric acid ion, a sulfuric acid ion, a p-toluenesulfonic acid ion and a trifluoromethanesulfonic acid ion.

In formula (I), $R_1$ preferably represents an aralkyl group, and at least one of $R_2$, $R_3$, $R_4$, $R_5$ and $R_6$ represents an aryl group.

In formula (I), more preferably, $R_1$ represents an aralkyl group, $R_4$ represents an aryl group, and $X^-$ represents an halogen ion.

Specific examples of the compounds used in the present invention are enumerated below, but the present invention is not limited thereto.

Crystal Habit Modifier (1)

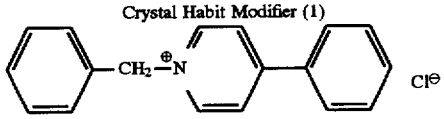

Crystal Habit Modifier (2)

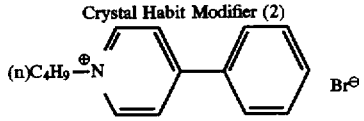

Crystal Habit Modifier (3)

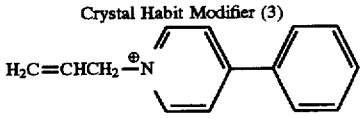

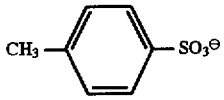

-continued

Crystal Habit Modifier (4)

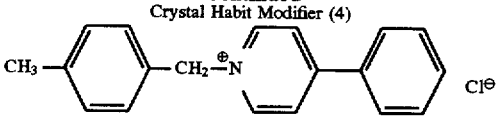

Crystal Habit Modifier (5)

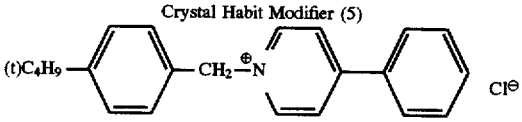

Crystal Habit Modifier (6)

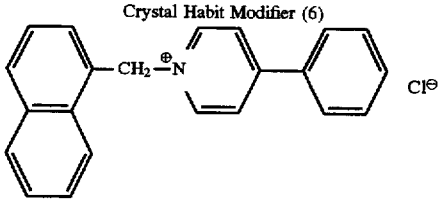

Crystal Habit Modifier (7)

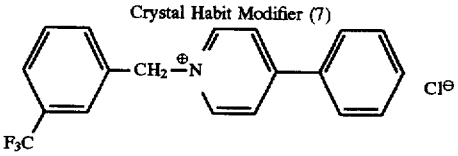

Crystal Habit Modifier (8)

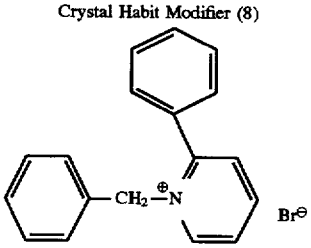

Crystal Habit Modifier (9)

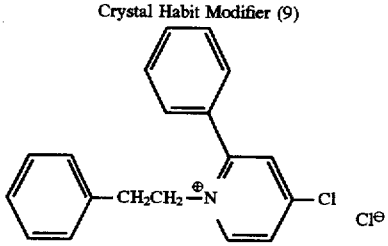

Crystal Habit Modifier (10)

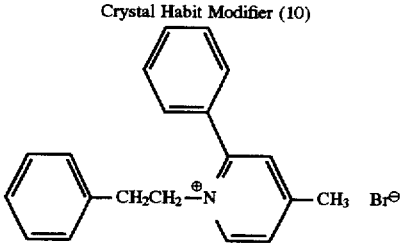

Crystal Habit Modifier (11)

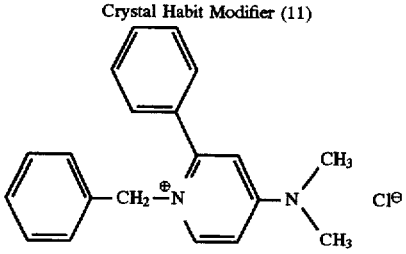

-continued

Crystal Habit Modifier (12)

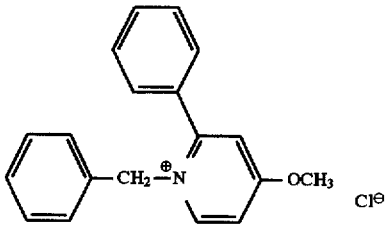

Crystal Habit Modifier (13)

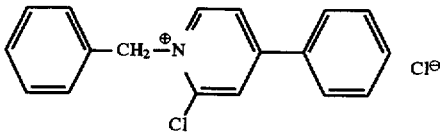

Crystal Habit Modifier (14)

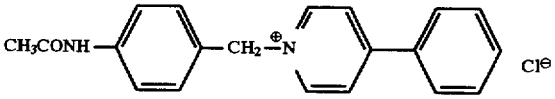

Crystal Habit Modifier (15)

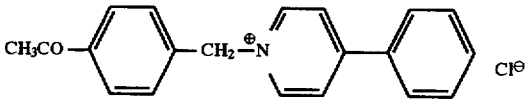

Crystal Habit Modifier (16)

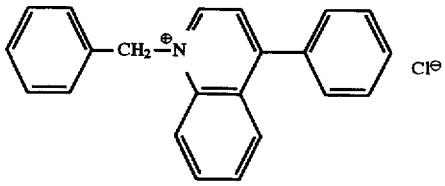

Crystal Habit Modifier (17)

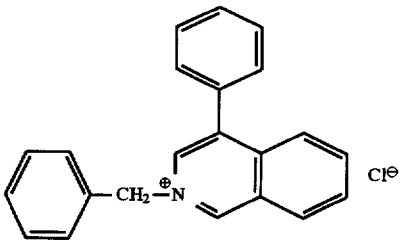

Crystal Habit Modifier (18)

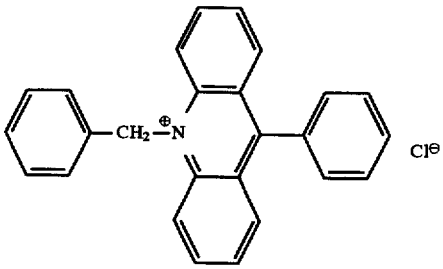

-continued

Crystal Habit Modifier (19)

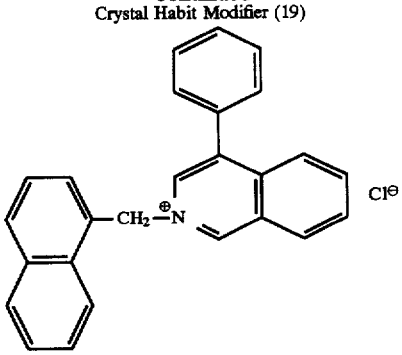

Crystal Habit Modifier (20)

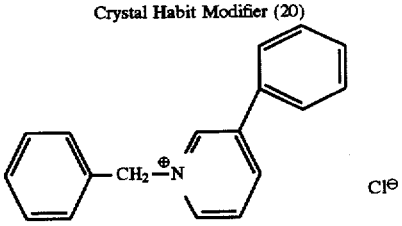

Crystal Habit Modifier (21)

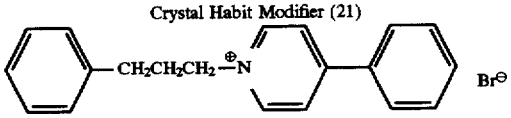

Crystal Habit Modifier (22)

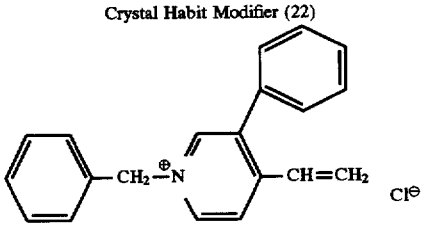

Crystal Habit Modifier (23)

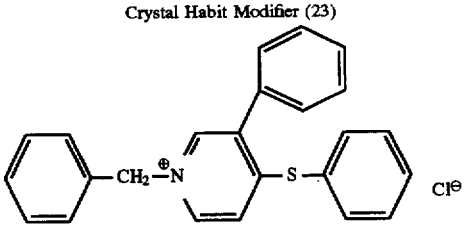

Crystal Habit Modifier (24)

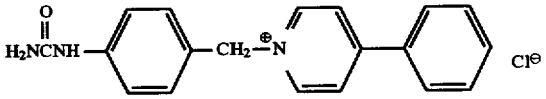

Crystal Habit Modifier (25)

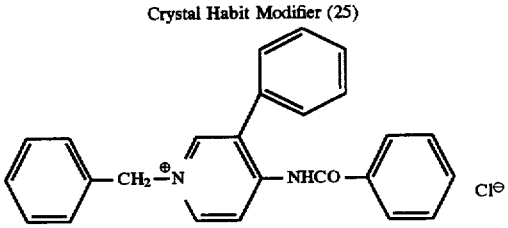

Crystal Habit Modifier (26)

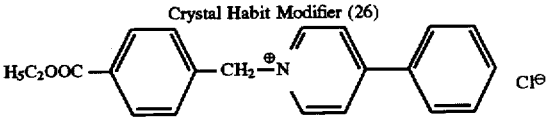

-continued

Crystal Habit Modifier (27)

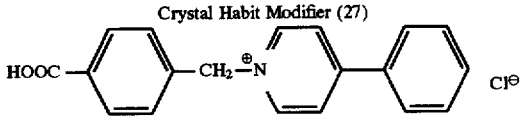

Crystal Habit Modifier (28)

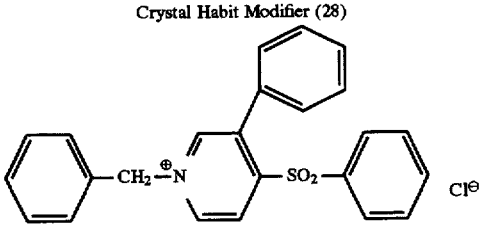

Crystal Habit Modifier (29)

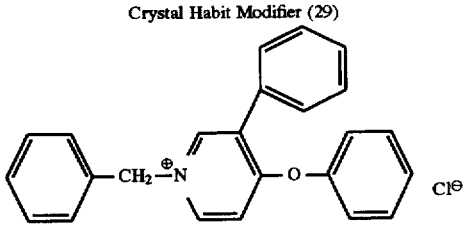

The compounds represented by formula (I) can be easily synthesized by the reaction of pyridine, quinoline, isoquinoline or acridine compounds easily available from the market with alkylating agents such as alkyl halides, and a specific synthesis example of the typical compound is shown below.

Synthesis Example 1 (Crystal Habit Modifier 1)

To 310.4 g (2 mol) of 4-phenylpyridine, 1.5 liters of isopropyl alcohol was added, and 379.6 g (3 mol) of benzyl chloride was added dropwise at room temperature. Then, the mixture was refluxed by heating for 4 hours, and isopropyl alcohol was concentrated to 750 ml under reduced pressure. After cooling to room temperature, precipitated crystals were filtered with suction to obtain 447.1 g (yield: 79.3%) of a desired product. The resulting product had a melting point of 230° C. or more. It was ascertained by the nuclear magnetic resonance spectrum, the mass spectrum, the infrared absorption spectrum and the element analysis that the resulting product was the desired product.

Then, the compounds of general formulas (II) and (III) used in the present invention is described in detail.

Each of $A_1$, $A_2$, $A_3$ and $A_4$ represents a nonmetallic atom group for completing a nitrogen-containing heterocyclic ring, may contain an oxygen atom, a nitrogen atom or a sulfur atom, and a benzene ring may be cyclocondensed to the heterocyclic ring. The heterocyclic ring composed of $A_1$, $A_2$, $A_3$ and $A_4$, which may be the same or different, may each have a substituent group. Examples of the substituent group represents an alkyl group, an aryl group, an aralkyl group, an alkenyl group, a halogen atom, an acyl group, an alkoxycarbonyl group, an aryloxycarbonyl group, a sulfo group, a carboxyl group, a hydroxyl group, an alkoxyl group, an aryloxy group, an amido group, a sulfamoyl group, a carbamoyl group, an ureido group, an amino group, a sulfonyl group, a cyano group, a nitro group, a mercapto group, an alkylthio group or an arylthio group. Preferred examples of $A_1$, $A_2$, $A_3$ and $A_4$ include 5-membered and 6-membered rings (for example, pyridine, imidazole, thiozole, oxazole, pyrazine and pyrimidine rings). The most preferred substituent group is a pyridine ring.

B represents a divalent connecting group, which include alkylene, arylene, alkenylene, —$SO_2$—, —SO—, —O—, —S—, —CO— or —N($R_2$)— (wherein $R_2$ represents an alkyl group, an aryl group or a hydrogen atom), or a combination thereof. Preferred examples of B include alkylene and alkenylene.

$R_1$ and $R_2$ each represents an alkyl group having 1 to 20 carbon atoms. $R_1$ and $R_2$ may be the same or different.

The alkyl group represents an unsubstituted or substituted alkyl group, and examples of the substituent groups substituted to the alkyl group are the same substituent groups as given for $A_1$, $A_2$, $A_3$ and $A_4$.

Preferred examples of $R_1$ and $R_2$ include alkyl groups each having 4 to 10 carbon atoms. More preferred examples thereof include unsubstituted or substituted aryl-substituted alkyl groups.

X represents an anion. Examples thereof include a chlorine ion, a bromine ion, a iodine ion, a nitric acid ion, a sulfuric acid ion, a p-toluenesulfonate and an oxalate. n represents 0 or 1, and n is 0 in the case of an internal salt.

Specific examples of the compounds represented by formula (II) or (III) are enumerated below, and other examples are disclosed in JP-A-2-32 (Compounds 1 to 42), but the present invention is not limited thereto.

Crystal Habit Modifier (30)

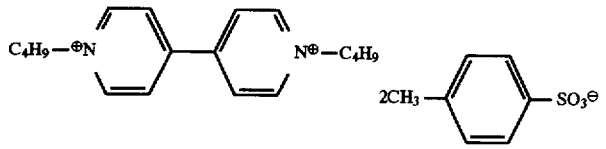

Crystal Habit Modifier (31)

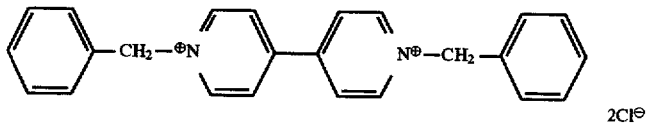

Crystal Habit Modifier (32)

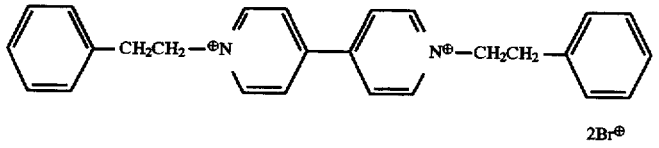

Crystal Habit Modifier (33)

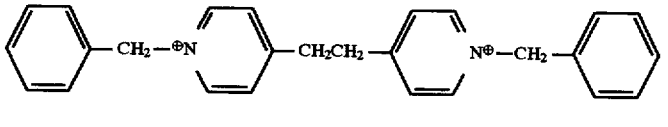

Crystal Habit Modifier (34)

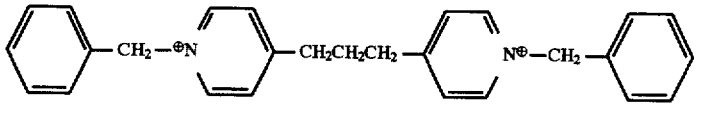

Crystal Habit Modifier (35)

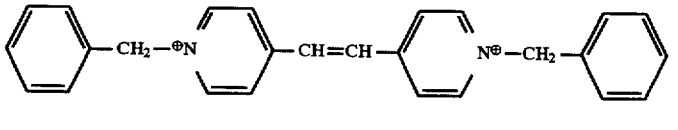

-continued
Crystal Habit Modifier (36)
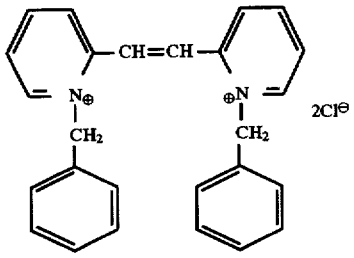
Crystal Habit Modifier (37)
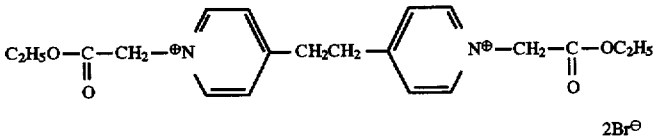
Crystal Habit Modifier (38)
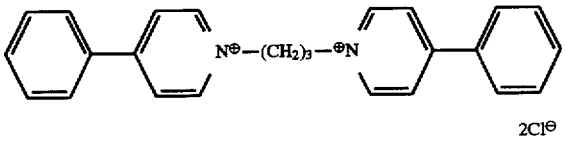
Crystal Habit Modifier (39)
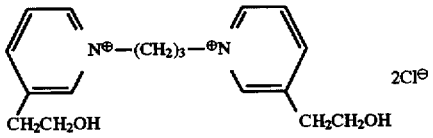
Crystal Habit Modifier (40)
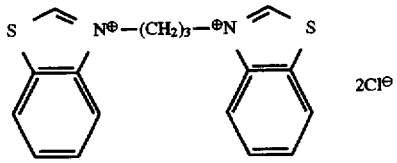
Crystal Habit Modifier (41)
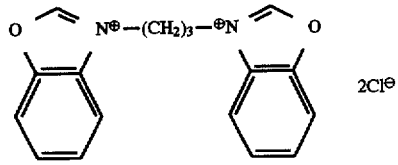
Crystal Habit Modifier (42)
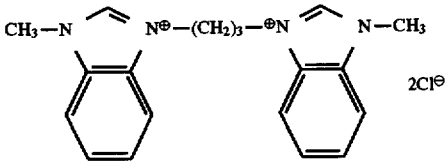
Crystal Habit Modifier (43)
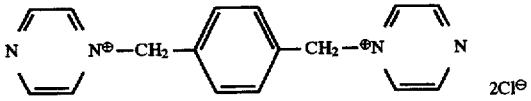

-continued

Crystal Habit Modifier (44)

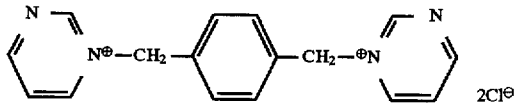

Crystal Habit Modifier (45)

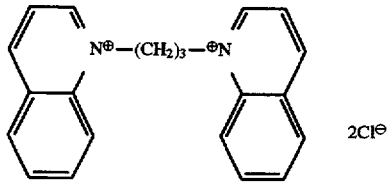

Crystal habit modification for forming silver halide grains having (111) faces on outer surfaces requires the compound of the present invention represented by formula (I), (II) or (III). The amount of the compound used is preferably $6\times10^{-5}$ mol or more per mol of silver halide contained in a final emulsion, and preferably is $3\times10^{-4}$ mol to $6\times10^{-2}$ mol.

The crystal habit modifier may be added at any time from nucleation of the silver halide grains to physical ripening and grain formation. After addition of the crystal habit modifier, formation of the (111) faces is initiated. The crystal habit modifier may previously be added to a reaction vessel, or may be added to a reaction vessel together with grain growth and increased in its concentration.

Using the crystal habit modifier of the present invention, regular crystalline (octahedral to tetradecahedral) and tabular grains having the (111) faces can be produced. Both can be produced properly mainly depending on the nucleation method, the time of addition of the crystal habit modifier and the amount thereof added. The nucleation methods are described below.

(1) When the regular crystalline grains are produced;

It is preferred that no crystal habit modifier is allowed to exist in nucleation. The chloride concentration in nucleation is generally 0.6 mol/liter or less, preferably 0.3 mol/liter or less, and more preferably 0.1 mol/liter or less.

(2) When the tabular grains are produced;

The tabular grain is obtained by forming two parallel twin faces. Formation of the twin faces depends on the temperature, the dispersion medium (gelatin), the halogen concentration, etc., so that these conditions are required to be suitably established. When the crystal habit modifier is allowed to exist in nucleation, the gelatin concentration is generally 0.1% to 10%, and preferably 0.15% to 5%. The chloride concentration is generally 0.01 mol/liter or more, and preferably 0.03 mol/liter or more.

When no crystal habit modifier is used in nucleation, the gelatin concentration is generally 0.03% to 10%, and preferably 0.05% to 1.0%. The chloride concentration is generally 0.001 mol/liter to 1 mol/liter, and preferably 0.003 mol/liter to 0.1 mol/liter. Although any temperature ranging from 2° C. to 90° C. can be selected as the nucleation temperature, a temperature ranging from 5° C. to 80° C. is preferred, and a temperature ranging from 5° C. to 40° C. is particularly preferred.

Then, the nuclei thus-formed are grown in the presence of the crystal habit modifier by physical ripening and addition of a silver salt and a chloride. In this case, the chloride concentration is generally 5 mol/liter or less, and preferably 0.08 mol/liter to 2 mol/liter. Although the temperature in grain growth can be selected within the range from 10° C. to 90° C., a temperature ranging from 30° C. to 80° C. is preferred. When the amount of the dispersion medium used in nucleation is insufficient for growth, it is necessary to supply the dispersion medium by addition. For growth, the amount of the gelatin used is preferably from 10 g/liter to 60 g/liter.

Although the Ph in grain growth is arbitrary, the neutral to acidic regions are preferred.

The high silver chloride grain used in the present invention means a grain having a silver chloride content of at least 50 mol %, preferably at least 80 mol %, and more preferably at least 95 mol %. A portion other than silver chloride is composed of silver bromide and/or silver iodide. A silver iodobromide layer may be localized on a surface of the grain. This is preferred for adsorption of a sensitizing dye. Further, the grain may be a so-called core/shell type grain.

The content of silver iodide is generally 20 mol % or less, preferably 10 mol % or less, and more preferably 3 mol % or less.

The silver halide grains of the present invention have surfaces comprising the (111) faces, and the (111) faces occupy 30% or more of their total surface area, preferably 40% or more, and more preferably 60% or more. The (111) faces can be determined by use of photomicrographs of the silver halide grains formed.

When the silver halide grains of the present invention are regular crystals, there in no particular limitation on the mean grain size (sphere-corresponding diameter). However, the mean grain size is preferably 0.1 μm to 5 μm, and more particularly 0.2 μm to 3 μm.

When the silver halide grains of the present invention are tabular grains, the diameter thereof is preferably 0.3 μm to 5.0 μm, and more preferably 0.5 μm to 3.0 μm. The diameter of the silver halide grain as used herein means the diameter of a circle having an area equal to a projected area of the grain observed in an electron microphotograph. Further, the thickness thereof is generally 0.4 μm or less, preferably 0.3 μm or less, and more preferably 0.2 μm or less. The volume weighted mean volume of the grains is preferably 2 $\mu m^3$ or less, and more preferably 1 $\mu m^3$ or less. Further, the diameter/thickness ratio thereof is preferably 2 or more, more preferably 2 to 20, and particularly preferably 3 to 10.

In general, the tabular grain has two parallel faces. In the present invention, therefore, the "thickness" is represented by the distance between the two parallel faces constituting the tabular grain.

The grain size distribution of the silver halide grains of the present invention may be either polydisperse or monodisperse, but it is more preferably monodisperse.

Methods for removing the crystal habit modifiers are shown below.

(1) After grain formation, the crystal habit modifiers are desorbed from the grains by exchange adsorption with the sensitizing dyes prior to the washing step. In general, it is difficult to effectively desorb the crystal habit modifiers by the adsorption force of the sensitizing dyes usually employed. Thiocyanates are therefore required to be used in combination. Various water-soluble salts such as KSCN, NaSCN and $NH_4SCN$ can be used as the thiocyanates. The thiocyanates may be added before or after addition of the sensitizing dyes, or at the same time. Examples of the sensitizing dyes include cyanine dyes, merocyanine dyes, complex cyanine dyes, complex merocyanine dyes, holopolar cyanine dyes, hemicyanine dyes, styryl dyes and hemioxonol dyes. Particularly useful examples of the dyes are cyanine dyes, merocyanine dyes and dyes belonging to complex merocyanine dyes. Any nuclei usually employed for cyanine dyes as basic heterocyclic nuclei may be applied to these dyes. That is, examples of the nuclei which can be applied include pyrroline, oxazoline, thiazoline, pyrrole, oxazole, selenazole, imidazole, tetrazole and pyridine nuclei; nuclei formed by condensing alicyclic hydrocarbon rings with these nuclei; and nuclei formed by condensing aromatic hydrocarbon rings with these nuclei, that is, indolenine, benzindolenine, indole, benzoxadole, naphthoxadole, benzothiazole, naphthothiazole, benzoselenazole, benzimidazole and quinoline nuclei. These heterocyclic nuclei may be substituted on carbon atoms.

Examples of nuclei having the ketomethylene structure applicable to the merocyanine or complex merocyanine dyes include 5-membered and 6-membered heterocyclic nuclei such as pyrazoline-5-one, thiohydantoin, 2-thiooxazolidine-2,4-dione, thiazolidine-2,4-dione, rhodanine and thiobarbituric acid nuclei.

For example, compounds described in *Research Disclosure*, Item 17643, Page 23, Paragraph IV (December, 1978) or in the literatures cited therein can be used.

The charge of the dyes in adsorption may be of the anion type or of the cation type, but the cation type is more effective for desorption of the crystal habit modifiers.

Specific examples of the sensitizing dyes are enumerated below, but the present invention is not limited thereto.

Sensitizing Dye 1

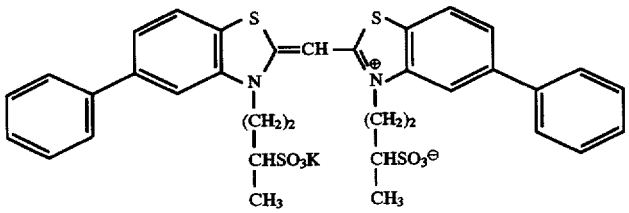

Sensitizing Dye 2

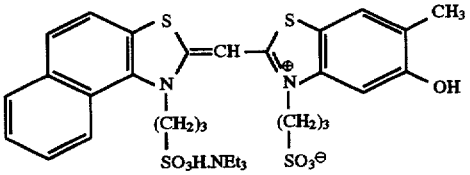

Sensitizing Dye 3

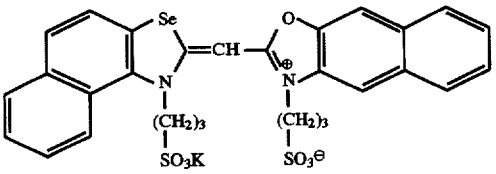

Sensitizing Dye 4

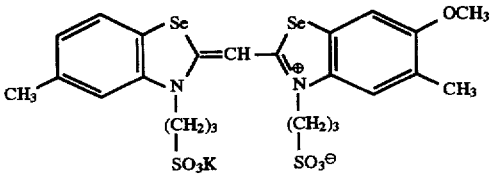

Sensitizing Dye 5

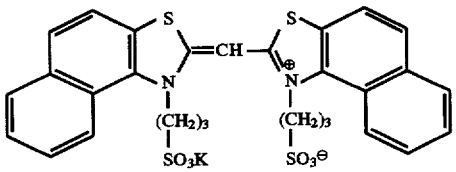

Sensitizing Dye 6

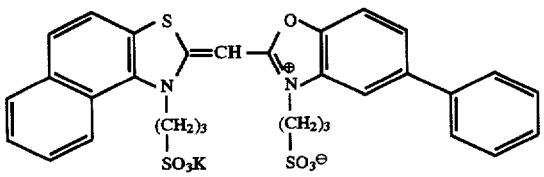

Sensitizing Dye 7

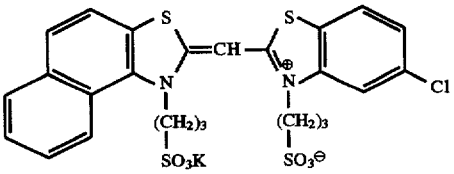

-continued
Sensitizing Dye 8
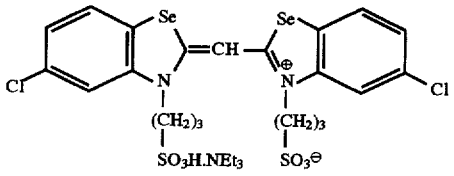
Sensitizing Dye 9
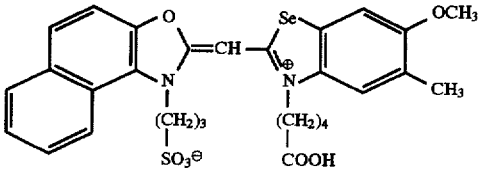
Sensitizing Dye 10
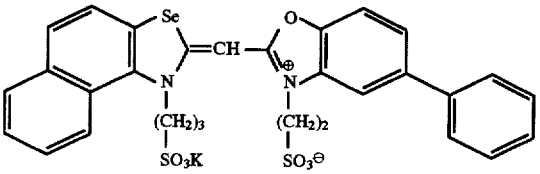
Sensitizing Dye 11
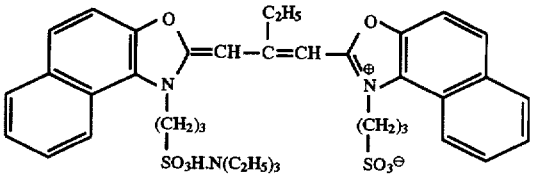
Sensitizing Dye 12
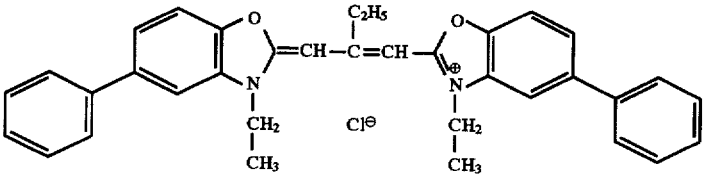
Sensitizing Dye 13
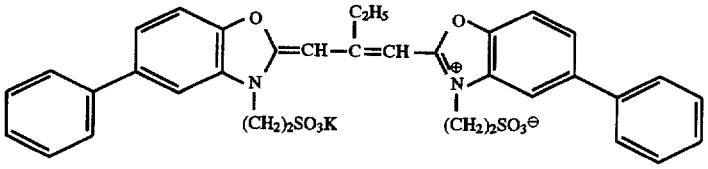
Sensitizing Dye 14
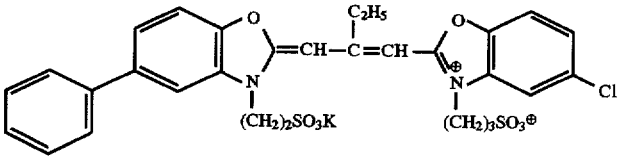
Sensitizing Dye 15
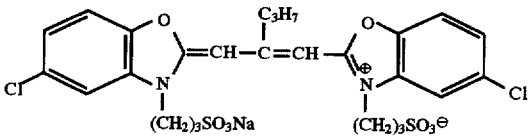
Sensitizing Dye 16
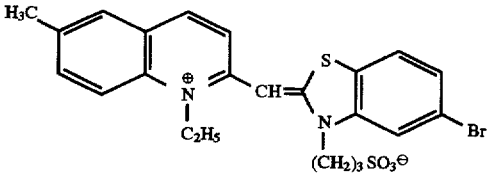
Sensitizing Dye 17
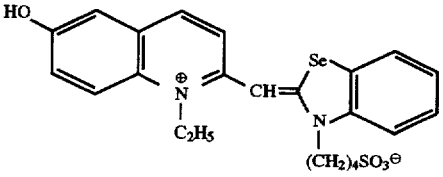
Sensitizing Dye 18
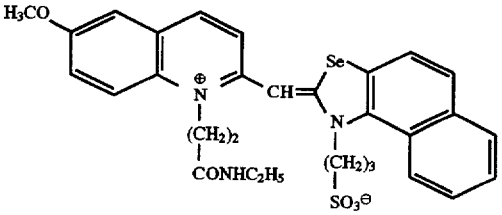

-continued
Sensitizing Dye 19
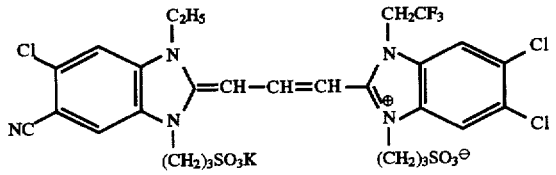
Sensitizing Dye 20
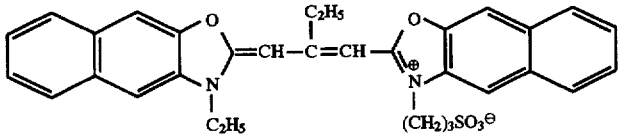
Sensitizing Dye 21
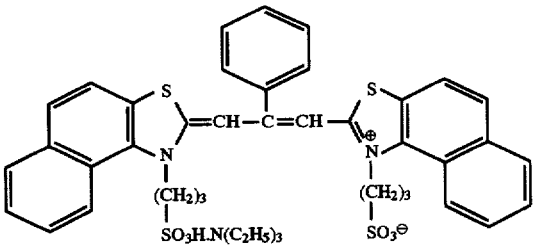
Sensitizing Dye 22
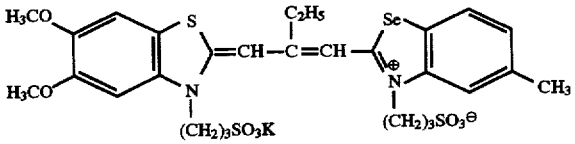
Sensitizing Dye 23
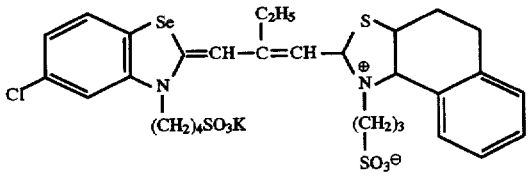
Sensitizing Dye 24
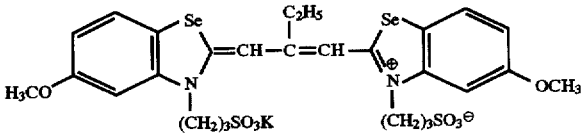
Sensitizing Dye 25
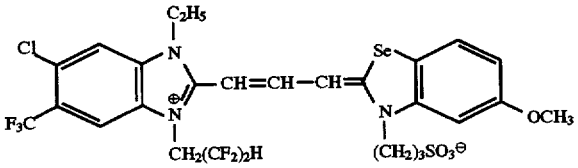
Sensitizing Dye 26
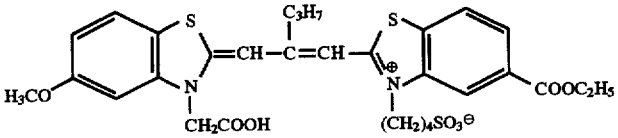

-continued
Sensitizing Dye 27
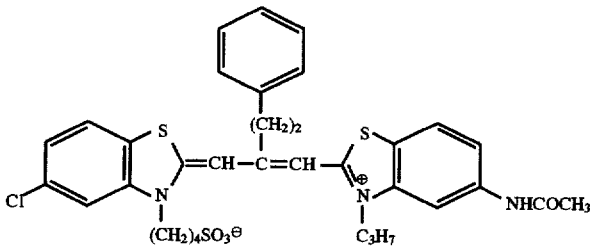
Sensitizing Dye 28
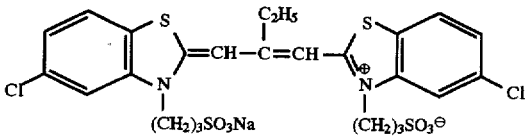
Sensitizing Dye 29
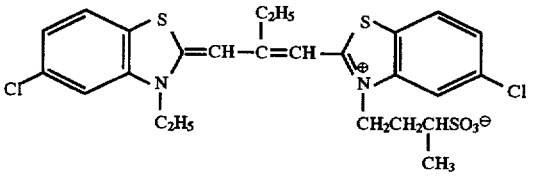
Sensitizing Dye 30
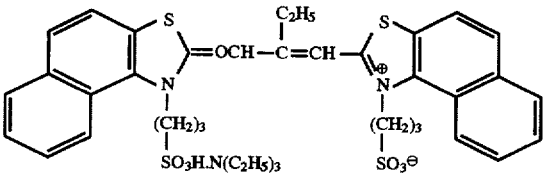
Sensitizing Dye 31
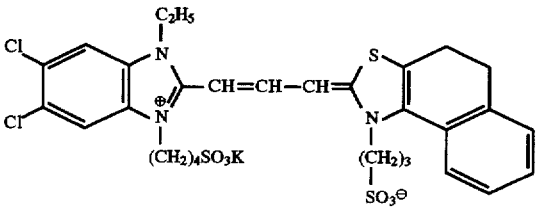
Sensitizing Dye 32
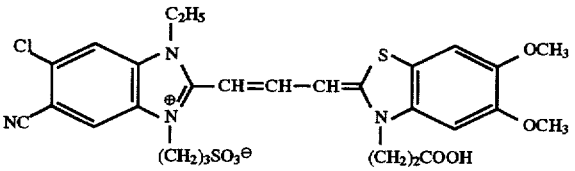
Sensitizing Dye 33
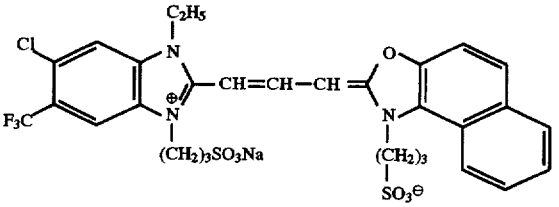
Sensitizing Dye 34
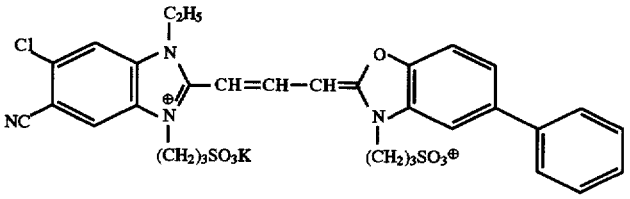
Sensitizing Dye 35
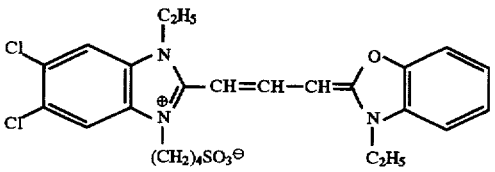
Sensitizing Dye 36
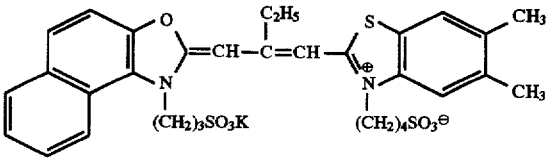

-continued
Sensitizing Dye 37
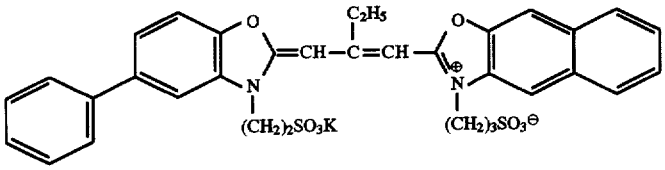
Sensitizing Dye 38
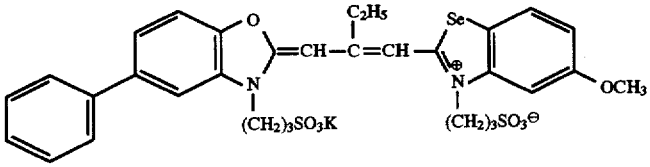
Sensitizing Dye 39
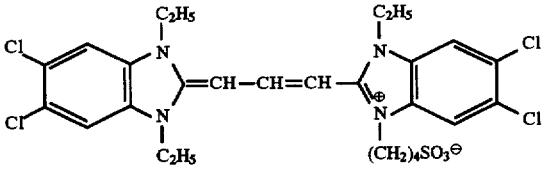
Sensitizing Dye 40
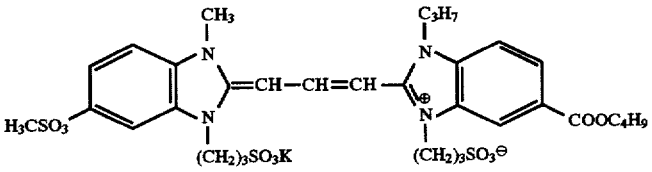
Sensitizing Dye 41
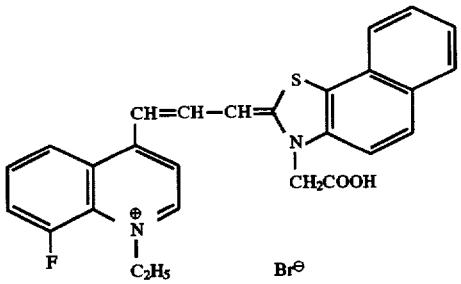
Sensitizing Dye 42
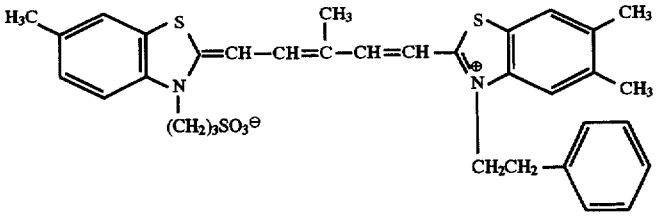

-continued
Sensitizing Dye 43
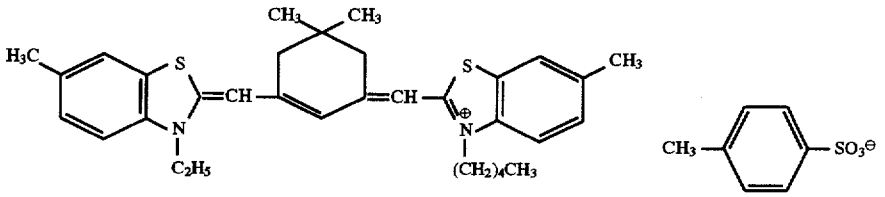
Sensitizing Dye 44
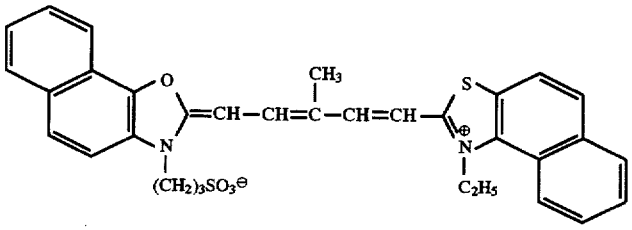
Sensitizing Dye 45
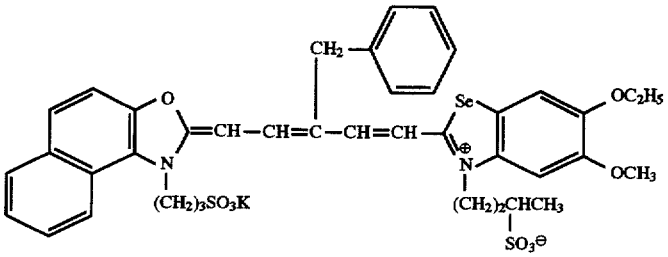
Sensitizing Dye 46
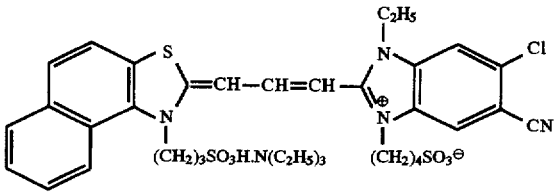
Sensitizing Dye 47
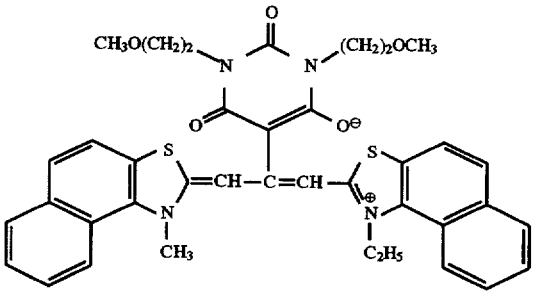
Sensitizing Dye 48
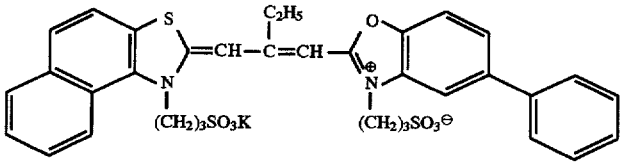
Sensitizing Dye 49
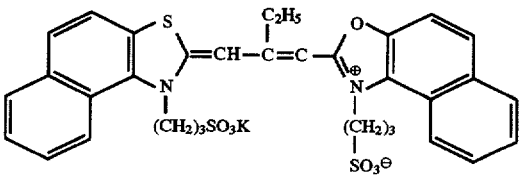

-continued

Sensitizing Dye 50

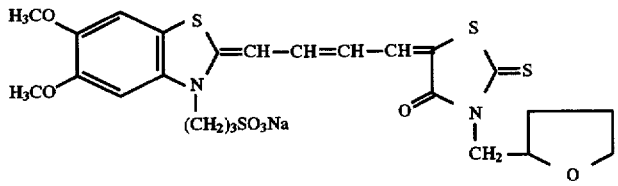

Sensitizing Dye 51

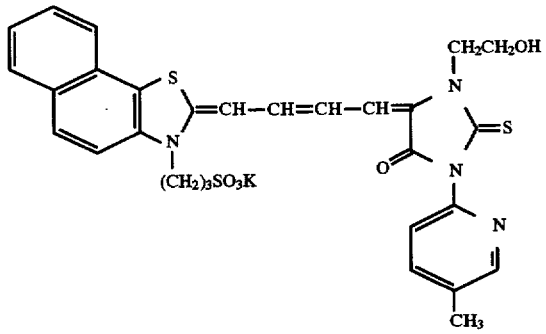

Sensitizing Dye 52

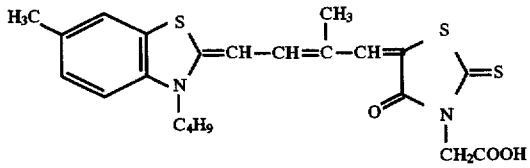

Sensitizing Dye 53

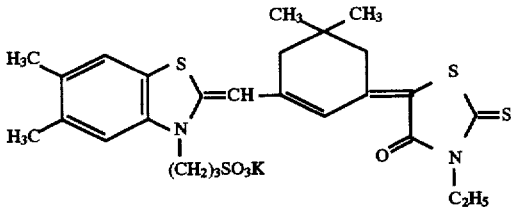

Sensitizing Dye 54

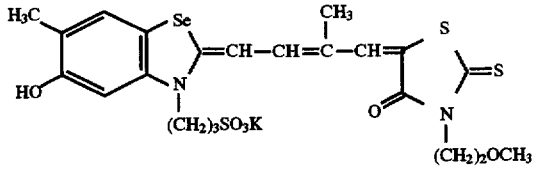

Sensitizing Dye 55

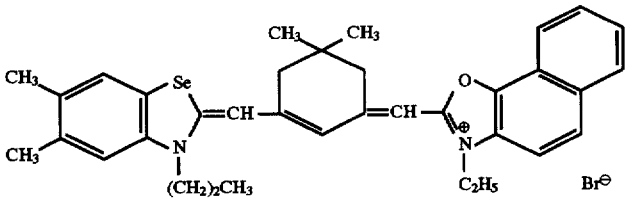

Sensitizing Dye 56

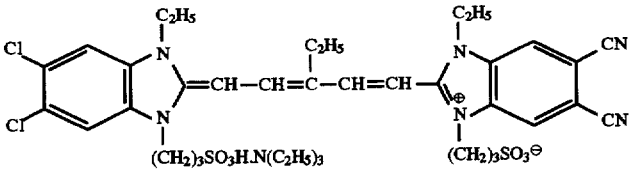

The use of the thiocyanates in combination with the sensitizing dyes results in desorption of the crystal habit modifiers from the grains, and the grain form is kept by the sensitizing dyes and the thiocyanates adsorbed in place of the crystal habit modifiers. The amount of the sensitizing dye added is preferably 50% to 300% of the amount for covering the surface of the grain with a monolayer, and more preferably 50% to 200%. If the amount is too much, the photographic characteristics are impaired in some cases. On the other hand, if the amount is too little, the grain form becomes unstable. The amount of the thiocyanate added is generally $1\times10^{-4}$ mol or more per mol of silver, preferably $1\times10^{-3}$ mol or more per mol of silver, and more preferably $2\times10^{-3}$ mol more per mol of silver.

The sensitizing dye may also be partly added after the washing step, for example, before chemical sensitization or coating.

(2) The crystal habit modifiers desorbed from the grains are removed by washing with water. The washing can be conducted at a temperature at which gelatin generally used as a protective colloid does not coagulate. In general, the sensitizing dyes are used as J aggregates formed on the surfaces of the grains. Higher temperature results in more promotion of J aggregate formation, causing enhancement of adsorption. On the other hand, higher temperature results in easier desorption of the crystal habit modifiers according to the present invention. The washing temperature is therefore preferably 40° C. or higher.

As the washing processes, various well-known techniques such as the flocculation process and the ultrafiltration process can be used. When the washing is performed by the flocculation process, it is necessary to use precipitants. Examples of the precipitants include ones containing sulfonic acid groups and ones containing carboxylic acid groups. The pyridinium salt crystal habit modifiers according to the present invention are strong in interaction with sulfonic acid groups, and therefore form salts with the precipitants, even if they are desorbed from the grains, thereby resulting in difficulty of removing them in the washing step. Accordingly, the precipitants having carboxylic acid groups but no sulfonic acid groups are preferably used. Examples of the precipitants having carboxylic acid groups are disclosed in British Patent 648,472.

Desorption of the crystal habit modifiers according to the present invention from the grains is promoted at a lower pH. It is therefore preferred that the pH in the washing step is low as long as the grains do not excessively coagulate.

The silver halide emulsions of the present invention may be either internal latent image type emulsions or surface latent image type emulsions.

In the production of the silver halide grains of the present invention, solvents for silver halides may be used.

Examples of the solvents for silver halides frequently used include thiocyanates (for example, described in U.S. Pat. Nos. 2,222,264, 2,448,534 and 3,320,069), thioether compounds (for example, described in U.S. Pat. Nos. 3,271,157, 3,574,628, 3,704,130, 4,297,439 and 4,276,347), thione compounds and thiourea compounds (for example, described in JP-A-53-144319, JP-A-53-82408 and JP-A-55-77737) and amine compounds (for example, described in JP-A-54-100717). Further, ammonia can also be used as long as it does not adversely affect.

In the course of formation of the silver halide grains or physical ripening, cadmium salts, zinc salts, lead salts, thallium salts, iridium salts or complex salts thereof, rhodium salts or complex salts thereof, iron salts or complex salts thereof, etc. may be coexisted. In particular, iridium salts or rhodium salts are preferred.

In the production of the silver halide grains of the present invention, a method are preferably used in which the rate of addition of a silver salt solution (for example, an aqueous solution of $AgNO_3$) and a halide solution (for example, an aqueous solution of NaCl) added for accelerating grain growth, the amount thereof added and the concentration thereof added are increased with the time of addition.

As to these methods, reference can be made to the descriptions of, for example, British Patent 1,335,925, U.S. Pat. Nos. 3,672,900, 3,650,757 and 4,242,445, JP-A-55-142329, JP-A-55-158124, JP-A-58-113927, JP-A-58-113928, JP-58-111934 and A-JP-58-111936.

The tabular silver halide grains according to the present invention may be not subjected to chemical sensitization, but can be subjected to chemical sensitization if necessary.

The chemical sensitization processes include so-called gold sensitization using gold compounds (for example, described in U.S. Pat. Nos. 2,448,060 and 3,320,069), sensitization using metals such as iridium, platinum, rhodium and palladium (for example, described in U.S. Pat. Nos. 2,448,060, 2,566,245 and 2,566,263), sulfur sensitization using sulfur-containing compounds (for example, described in U.S. Pat. No. 2,222,264), selenium sensitization using selenium compounds and reduction sensitization using tin salts, thiourea dioxide, polyamines, etc. (for example, described in U.S. Pat. Nos. 2,487,850, 2,518,698 and 2,521,925). They may be used as a combination of two or more.

In the present invention, gold sensitization, sulfur sensitization and a combination thereof are particularly preferred.

Emulsion layers of the silver halide grains of the present invention can contain normal silver halide grains, in addition to the silver halide grains according to the present invention.

In photographic emulsions containing high silver chloride grains according to the present invention, the high silver chloride grains occupy 50% or more of the projected surface area of the total silver halide grains, preferably 70% or more, and more preferably 90% or more.

Also when mixtures of the photographic emulsions according to the present invention and other photographic emulsions are used, the mixtures are preferably prepared so as to allow 50% or more of the high silver chloride grains according to the present invention to exist in the mixed emulsions.

Further, when the mixtures of the photographic emulsions according to the present invention and the other photographic emulsions are used, it is more preferred that said other photographic emulsions are also high silver chloride emulsions containing 50 mol % or more of silver chloride.

The silver halide emulsions prepared by the present invention can be used for both color photographic materials and black-and-white photographic materials. Examples of the color photographic materials include color paper, color photographing films and color reversal films, and examples of the black-and-white photographic materials include X-ray films, general photographing films and films for photographic materials for graphic arts printing. In particular, they can be preferably used for color paper and black-and-white photographic materials.

There in no particular limitation on other additives to the photographic materials to which the emulsions according to the present invention are applied, and reference can be made to the descriptions of, for example, *Research Disclosure*, Vol. 176, Item 17643 (RD17643) and ibid., Vol. 187, Item 18716 (RD18716).

Portions of RD17643 and RD18716 in which various additives are described are listed below:

| Type of Additives | RD17643 | RD18716 |
|---|---|---|
| 1. Chemical Sensitizers | p. 23 | p. 648, right column |
| 2. Sensitivity Increasing Agents | | p. 648, right column |
| 3. Spectral Sensitizers, Supersensitizers | pp. 23–24 | p.648, right column to p. 649, right column |
| 4. Brightening Agents | p. 24 | |
| 5. Antifoggants, Stabilizers | pp. 24–25 | p. 649, right column |
| 6. Light Absorbers, Filter dyes, UV Absorbers | pp. 25–26 | p. 649, right column to p. 650, left column |
| 7. Stain Inhibitors | p. 25, right column | p. 650, left to right columns |
| 8. Dye Image Stabilizers | p. 25 | |
| 9. Hardeners | p. 26 | p. 651, left column |
| 10. Binders | p. 26 | p. 651, left column |
| 11. Plasticizers, Lubricants | p. 27 | p. 650, right column |
| 12. Coating Aids, Surfactants | pp. 26–27 | p. 650, right column |
| 13. Antistatic Agents | p. 27 | p. 650, right column |

Of the above-mentioned additives, examples of compounds which can be preferably used as antifoggants or stabilizers include azoles such as benzothiazolium salts, nitroimidazoles, nitrobenzimidazoles, chlorobenzimidazoles, bromobenzimidazoles, nitroindazoles, benzotriazoles and aminotriazoles; mercapto compounds such as mercaptothiazoles, mercaptobenzothiazoles, mercaptobenzimidazoles, mercaptothiadiazoles, mercaptotetrazoles (particularly, 1-phenyl-5-mercaptotetrazole), mercaptopyrimidines and mercaptotriazines; thioketo compounds such as oxazolinethione; azaindenes such as triazaindenes, tetraazaindenes (particularly, 4-hydroxy-substituted (1,3,3a,7)-tetraazaindenes) and pentaazaindenes; benzenethiosulfonic acid; benzenesulfinic acid; and benzenesulfonic acid amide.

As color couplers, non-diffusible couplers having hydrophobic groups called "ballast groups" in molecules or polymerized couplers are preferably used. The coupler may be either 4 equivalents or 2 equivalents based on silver ion. Colored couplers having the effect of color correction or couplers releasing development inhibitors with the progress of development (so-called DIR couplers) may be contained. Further, non-coloring DIR couplers providing colorless products by coupling reactions and releasing development inhibitors may be contained.

Examples of magenta couplers include 5-pyrazolone couplers, pyrazolobenzimidazole couplers, pyrazolotriazole couplers, pyrazolotetrazole couplers, cyanoacetylcoumarone couplers and open-chain acylacetonitrile couplers. Examples of yellow couplers include acylacetamide couplers (for example, benzoylacetanilides and pivaloylacetanilides). Examples of cyan couplers include naphthol couplers and phenol couplers. As the cyan couplers, a phenol coupler having an ethyl group at the meta-position of a phenol nucleus, a 2,5-diacylamino-substituted phenol coupler, a phenol coupler having a phenylureido group at the 2-position and an acylamino group at the 5-position and a coupler substituted by a sulfonamido group or an amido group at the 5-position of a naphthol nucleus, which are described in U.S. Pat. Nos. 3,772,002, 2,772,162, 3,758,308, 4,126,396, 4,334,011, 4,327,173, 3,446,622, 4,333,999, 4,451,559 and 4,427,767, are preferably used because of their excellent image fastness.

In order to satisfy the characteristics required for the photographic materials, two or more of the above-mentioned couplers can be used in combination in the same layer, or the same compound may be of course added to two or more different layers.

Typical examples of antifading agents include hydroquionens, 6-hydroxychromans, 5-hydroxycoumarans, spirochromans, p-alkoxyphenols, hindered phenols such as bisphenols, gallic acid derivatives, methylenedioxybenzenes, aminophenols, hindered amines and ether or ester derivatives obtained by silylating or alkylating phenolic hydroxyl groups of these compounds. Further, metal complexes represented by (bissalicylaldoximato)nickel complexes and (bis-N,N-dialkyldithiocarbamato)nickel complexes can also be used.

For photographic processing of the photographic materials produced by the present invention, any of the well-known methods can be used, and well-known processing solutions can be used. The processing temperature is usually selected between 18° C. and 50° C., but it may be lower than 18° C., or higher than 50° C. Both development processing for forming silver images (black-and-white photographic processing) and color photographic processing comprising development processing for forming dye images are applicable according to their purpose.

In black-and-white developing solutions, well-known developing agents such as dihydroxybenzenes (for example, hydroquinone), 3-pyrazolidones (for example, 1-phenyl-3-pyrazolidone) and aminophenols (for example, N-methyl-p-aminophenol) aminophenol) can be used alone or in combination.

Color developing solutions are generally aqueous alkaline solution containing color developing agents. As the color developing agents, there can be used known aromatic primary amine developing agents such as phenylenediamines (for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline and 4-amino-3-methyl-N-ethyl-N-β-methoxyethylaniline).

Besides these, additives described in L. F. A. Maison, *Photographic Processing Chemistry*, Focal Press, pp. 226–229 (1966), U.S. Pat. Nos. 2,193,015 and 2,592,364, JP-A-48-64933, etc. may also be used.

In addition, the color developing solutions can contain pH buffers such as sulfites, carbonates, borates and phosphates, of alkali matals; and developing inhibitors or antifoggants such as bromides, iodides and organic antifoggants. Further, the color developing solutions may contain hard-water softeners, preservatives such as hydroxylamine, organic solvents such as benzyl alcohol and diethylene glycol, development accelerators such as polyethylene glycol, quaternary ammonium salts and amines, dye forming couplers, competitive couplers, fogging agents such as sodium boron hydride, auxiliary developing agents such as 1-phenyl-3-pyrazolidone, tackifiers, polycarboxylic acid chelating agents described in U.S. Pat. No. 4,083,723 and antioxidants described in German Patent Application (OLS) No. 2,622,950, as required.

In the case of the color photographic processing, the photographic materials are generally subjected to bleach-processing after color development. Bleach-processing may be carried out simultaneously with fix-processing or separately. As bleaching agents, for example, compounds of polyvalent metals such as iron (III), cobalt (III), chromium (IV) and copper (II), peracids, quinones and nitroso compounds are used. Typical examples of the bleaching agents include ferricyanides; bichromates; organic complex salts of iron (III) or cobalt (III), for example, complex salts of aminopolycarboxylic acids such as ethylenediaminetetraacetic acid, nitrilotriacetic acid and 1,3-diamino-2-propanoltetraacetic acid, or complex salts of organic acids such as citric acid, tartaric acid and maleic acid; persulfates; permanganates; and nitrosophenol. Of these, potassium ferricyanide, sodium ethylenediaminetetraacetato iron (III) and ammonium ethylenediaminetetraacetato iron (III) are particularly useful. The complex salts of ethylenediaminetetraacetato iron (III) are also useful for both independent bleaching solutions and one bath-bleach-fixing solution.

The bleaching or bleach-fixing solutions may also contain various additives, in addition to bleaching accelerator described in U.S. Pat. Nos. 3,042,520 and 3,241,966, JP-B-45-8506 (the term "JP-B" as used herein means an "examined Japanese patent publication"), JP-B-45-8836etc. and thiol compounds described in JP-A-53-65732. After bleaching or bleach-fixing, the photographic materials may be subjected to washing, or may only be subjected to stabilizing processing.

The present invention will be described in more detail with-reference to examples below.

EXAMPLE 1

(Preparation of Regular Crystal Grains of Pure Silver Chloride)

To 1 liter of water, 4.8 g of sodium chloride and 30 g of inactive gelatin were added. Then, 600 ml of an aqueous solution of silver nitrate (silver nitrate: 21.3 g) and 600 ml of an aqueous solution of sodium chloride (sodium chloride: 7.74 g) were added thereto in a vessel maintained at 60° C. with stirring by the double jet process for 20 minutes. Five minutes after termination of addition, $2.4\times10^{-3}$ mol of Crystal Habit Modifier 1 or $1.2\times10^{-3}$ mol of Crystal Habit Modifier 33 was added thereto. A molecule containing a $^{14}C$ radioisotope was intentionally mixed with the crystal habit modifier. Then, 5 minutes after addition of the crystal habit modifier, 300 ml of an aqueous solution of silver nitrate (silver nitrate: 112.5 g) and 300 ml of an aqueous solution of sodium chloride (sodium chloride: 40.14 g) were added thereto for 60 minutes.

After termination of addition, potassium thiocyanate shown in Table 1 was added at 60° C. After 10 minutes, Sensitizing Dye 12 or Sensitizing Dye 13 was added, and stirring was further continued for 20 minutes.

Lowering the temperature to 40° C., an aqueous solution containing Precipitant 1 or Precipitant 2 was added to bring the total volume up to 3 liters. Thereafter, the pH was lowered with sulfuric acid until the silver halide was precipitated (pH=3.8). Then, 85% of a supernatant (Supernatant 1 (S1)) was removed (first washing). Further, distilled water was added in the same amount as removed, and sulfuric acid was added until the silver halide was precipitated. Then, 85% of a supernatant (Supernatant 2 (S2)) was removed again (second washing). Distilled water was further added in the same amount as removed, and sulfuric acid was added until the silver halide was precipitated. Then, 85% of a supernatant (Supernatant 3 (S3)) was removed again (third washing), thus completing the desalting step.

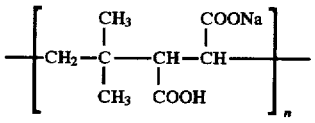

Precipitant 1

Average molecular weight: 120,000

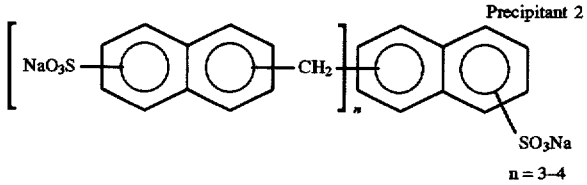

Precipitant 2

Average molecular weight: ca.1200

Eighty grams of gelatin, 85 ml of phenol (5%) and 242 ml of distilled water were added thereto. The solution was adjusted to pH 6.2 and pAg 7.5 with sodium hydroxide and a silver nitrate solution. Thus, octahedral grains of pure silver chloride having a mean sphere-corresponding diameter of 0.55 μm were obtained.

The amount of the crystal habit modifier contained in Supernatants S1 to S3 was determined by the liquid scintillation process. The amount (the ratio to the amount added) of the crystal habit modifier contained in supernatants in washing under various conditions is shown in Table 1. The results show that washing by the flocculation process after addition of potassium thiocyanate and the cyanine dye according to the present invention significantly promotes desorption of the crystal habit modifier.

Further, the results show that use of carboxylic acid type Precipitant 1 can cause effective removal of the crystal habit modifier as compared with use of sulfonic acid type Precipitant 2 in washing by the flocculation process.

TABLE 1

| Additive | | Ratio of the Amount of Crystal Habit Modifier to the Amount Added (%) Crystal Habit Modifier 1 | Crystal Habit Modifier 33 | |
|---|---|---|---|---|
| | | <Emulsion O-1> | <Emulsion O-8> | |
| KSCN | In S1 | 94.8 | 78.0 | |
| Sensitizing Dye 12 | In S2 | 15.3 | 11.4 | |
| | In 53 | 5.7 | 2.4 | Invention |
| Precipitant 1 | Grains* | 1.8 | 21.5 | |
| | | <Emulsion O-2> | <Emulsion O-9> | |
| KSCN | In S1 | 93.3 | 75.3 | |
| Sensitizing Dye 13 | In S2 | 14.8 | 12.2 | |
| | In S3 | 3.7 | 3.5 | Invention |
| Precipitant 1 | Grains* | 5.0 | 22.7 | |
| | | <Emulsion O-3> | <Emulsion O-10> | |
| Sensitizing Dye 12 | In S1 | 70.7 | 57.9 | |
| | In S2 | 15.5 | 7.1 | Comparison |
| Precipitant 1 | In S3 | 7.8 | 1.0 | |
| | Grains* | 20.1 | 43.9 | |
| | | <Emulsion O-4> | <Emulsion O-11> | |
| Sensitizing Dye 13 | In S1 | 65.9 | 50.8 | |
| | In S2 | 16.1 | 9.5 | Comparison |
| Precipitant 1 | In S3 | 8.0 | 2.7 | |
| | Grains* | 23.5 | 46.5 | |
| | | <Emulsion O-5> | <Emulsion O-12> | |
| KSCN | In S1 | 71.0 | 57.0 | |
| Precipitant 1 | In S2 | 16.5 | 12.1 | Comparison |
| | In S3 | 8.2 | 4.1 | |
| | Grains* | 18.7 | 37.8 | |
| | | <Emulsion O-6> | <Emulsion O-13> | |
| Precipitant 1 | In S1 | 68.8 | 53.2 | |
| | In S2 | 16.0 | 11.1 | Comparison |
| | In S3 | 7.8 | 3.5 | |
| | Grains* | 21.3 | 42.4 | |
| | | <Emulsion O-7> | <Emulsion O-14> | |
| Precipitant 2 | In S1 | 56.5 | 36.3 | |
| | In S2 | 15.6 | 8.7 | Comparison |
| | In S3 | 7.4 | 2.5 | |
| | Grains* | 32.4 | 59.5 | |

Determination of Crystal Habit Modifier in Emulsion Using $^{14}C$ Isotope
Crystal Habit Modifier 1 was added in an amount of $2.4\times10^{-3}$ mol.
Crystal Habit Modifier 33 was added in an amount of $1.2\times10^{-3}$ mol.
KSCN was added in an amount of $4\times10^{-3}$ mol per mol of silver.
Each sensitizing dye was added in an amount of $5\times10^{-4}$ mol per mol of silver.
Precipitants 1 and 2 were added in amounts of 1.5 g and 2.5 g per 30 g of gelatin, respectively.
* The residual amount of crystal habit modifier in grains: 85% of Supernatants S1 to S3 were removed. Calculation was therefore made, taking that 85% of the crystal habit modifier in the supernatants was removed.

EXAMPLE 2

(Preparation of Tabular Grains of Pure Silver Chloride)

To 1.68 liters of water, 3.8 g of sodium chloride, 3 mmol of Crystal Habit Modifier 1 and 10 g of inactive gelatin were added. Then, 28.8 ml of an aqueous solution of silver nitrate (silver nitrate: 7.34 g) and 28.8 ml of an aqueous solution of sodium chloride (sodium chloride: 2.71 g) were added thereto in a vessel maintained at 30° C. with stirring by the double jet process for 1 minutes. Two minutes after termination of addition, 188 g of a 10% aqueous solution of inactive gelatin was added. Then, the temperature of the reaction vessel was elevated to 75° C. for 15 minutes. After ripening at 75° C. for 12 minutes, 480 ml of an aqueous solution of silver nitrate (silver nitrate: 122.7 g) and an aqueous solution of sodium chloride were added at an accelerated flow rate for 39 minutes. During this, the potential was kept at +100 mV to a saturated calomel electrode.

After termination of addition, potassium thiocyanate described in Table 2 was added at 60° C. After 10 minutes, Sensitizing Dye 13 described in Table 2 was added, and stirring was further continued for 20 minutes.

Lowering the temperature to 40° C., an aqueous solution containing 1.5 g of Precipitant 1 was added to bring the total volume up to 3 liters. Thereafter, washing was conducted by the same flocculation process as with Example 1.

Eighty grams of gelatin, 85 ml of phenol (5%) and 242 ml of distilled water were added thereto. The solution was adjusted to pH 6.2 and pAg 7.5 with sodium hydroxide and a silver nitrate solution. Thus, emulsions Σ1 to Σ4 containing tabular grains of pure silver chloride having a mean sphere-corresponding diameter of 0.85 μm and a mean thickness of 0.12 μm were obtained.

TABLE 2

| | Additive | | |
|---|---|---|---|
| Emulsion | KSCN | Sensitizing Dye | Precipitant |
| Σ1 | Added | 13 | 1 |
| Σ2 | Not added | 13 | 1 |
| Σ3 | Added | Not added | 1 |
| Σ4 | Not added | Not added | 1 |

Desorption Conditions of Crystal Habit Modifier in Emulsions Containing Tabular Grains KSCN was added in an amount of $4\times10^{-3}$ mol per mol of silver.

The sensitizing dye was added in an amount of $7\times10^{-4}$ mol per mol of silver.

Precipitant 1 was added in an amount of 1.5 g per 28.8 g of gelatin.

EXAMPLE 3

(Preparation of Coating Samples for Evaluation of Photographic Characteristics)

Emulsions O-1 to O-14 containing octahedral grains produced in the same manner as in Example 1 with the exception that the $^{14}C$-containing crystal habit modifiers were replaced by crystal habit modifiers each containing no $^{14}C$ radioisotopes were used were subjected to optimum chemical sensitization at 60° C. by use of 4-hydroxy-6-methyl-1,3,3a,7-tetraazaindene, sodium thiosulfate and chloroauric acid.

Further, emulsions Σ1 to Σ4 containing the tabular grains of Example 2 were subjected to optimum chemical sensitization at 60° C. by use of 4-hydroxy-6-methyl-1,3,3a,7-tetraazaindene, sodium thiosulfate, Selenium Compound 1 and chloroauric acid.

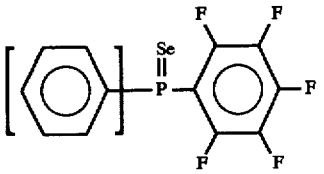

Selenium Compound 1

The following compounds were added in amounts shown below (per mol of silver halide) to each of the emulsions subjected to the above-mentioned chemical sensitization.

Gelatin 111 g 2,6-Bis(hydroxyamino)-4-diethyl-0.11 g amino-1,3,5-triazine

Dextran 18.8 g (average molecular weight: 39,000)

Polysodium Acrylate 5.1 g (average molecular weight: 400,000)

Polysodium Styrenesulfonate 1.8 g (average molecular weight: 600,000)

Compound T1 0.04 g

Hardener (1,2-Bis(vinylsulfonylacetamide)ethane

Adjusted so as to give a swelling rate of 230%

Adjusted to pH 6.2 with NaOH.

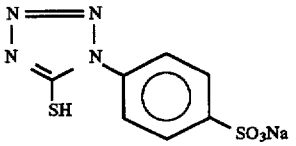

Compound T1

Before coating, Sensitizing Dye 12, Sensitizing Dye 13 or KSCN was added to the emulsions containing no sensitizing dye or no KSCN (see Table 3). The sensitizing dye was added in an amount of $5\times10^{-4}$ mol per mol of silver for the octahedral grains, and in an amount of $7\times10^{-4}$ mol per mol of silver for the tabular grains. KSCN was added in an amount of $4\times10^{-3}$ mol per mol of silver for both the octahedral grains and the tabular grains.

Each of the above-mentioned coating solutions and a surface protective layer were applied to a triacetyl cellulose support by the co-extrusion process. The amount of silver coated was 1.4 g/m$^2$ per one side surface.

EXAMPLE 4

(Evaluation of Photographic Characteristics)

The experiment described in Tadaaki Tani and Hitoshi Urabe, *Nippon Shashin Gakkaishi*, 41, 325 (1978) was conducted to determine the relative quantum efficiency (Φr) of spectral sensitization. The samples were exposed through an interference filter at 365 nm for the specific sensitivity, and at 550 nm for the spectral sensitivity. The exposure time was 5 seconds. The sensitivity was indicated by the reciprocal of an exposure amount required to give a density of (fog+0.2). The composition of a developing solution used are shown below.

Metol 2.5g

L-Ascorbic Acid 10.0 g

NABOX 35.0 g

NaCl 0.5 g

Water to make 1 liter

"Φr" indicates the efficiency of injecting photons absorbed by a sensitizing dye into silver halide grains, and a Φr of 1 means that the photons can be injected at an efficiency of 100% (without loss).

The results are shown in Table 3. It is clearly seen from the results that addition of both KSCN and the sensitizing dye before the washing step results in a high Φr. Further, it is seen from the results that the grains formed by use of Crystal Habit Modifier 1 have a higher Φr as compared with the grains formed by use of Crystal Habit Modifier 2. Furthermore, it is clearly seen from the results that the Cationic Sensitizing Dye 1 has a higher Φr as compared with the Anionic Sensitizing Dye 2. These results well corresponded to the results of the removal of crystal habit modifiers. That is, a higher removal ratio of crystal habit modifiers resulted in a higher Φr.

TABLE 3

Results of Evaluation of Photographic Characteristics

| Coating Sample | Emulsion | Crystal Habit Modifier | Sensitizing Dye and Time of Addition | Time of Addition of KSCN | Precipitant | $\phi r$ | |
|---|---|---|---|---|---|---|---|
| 1 | O-1 | 1 | 1 Before washing | Before washing | 1 | 0.78 | Invention |
| 2 | O-2 | 1 | 2 Before washing | Before washing | 1 | 0.78 | Invention |
| 3 | O-3 | 1 | 1 Before washing | Not added | 1 | 0.30 | Comparison |
| 4 | o-4 | 1 | 2 Before washing | Not added | 1 | 0.11 | Comparison |
| 5 | O-3 | 1 | 1 Before washing | Before coating | 1 | 0.40 | Comparison |
| 6 | O-4 | 1 | 2 Before washing | Before coating | 1 | 0.37 | Comparison |
| 7 | O-5 | 1 | 2 Before coating | Before washing | 1 | 0.35 | Comparison |
| 8 | O-6 | 1 | 2 Before coating | Before coating | 1 | 0.29 | Comparison |
| 9 | O-7 | 1 | 2 Before coating | Before coating | 2 | 0.25 | Comparison |
| 10 | O-8 | 33 | 1 Before washing | Before washing | 1 | 0.62 | Invention |
| 11 | O-9 | 33 | 2 Before washing | Before washing | 1 | 0.57 | Invention |
| 12 | O-10 | 33 | 1 Before washing | Not added | 1 | 0.19 | Comparison |
| 13 | O-11 | 33 | 2 Before washing | Not added | 1 | 0.00 | Comparison |
| 14 | O-10 | 33 | 1 Before washing | Before coating | 1 | 0.46 | Comparison |
| 15 | O-11 | 33 | 2 Before washing | Before coating | 1 | 0.26 | Comparison |
| 16 | O-12 | 33 | 2 Before coating | Before washing | 1 | 0.24 | Comparison |
| 17 | O-13 | 33 | 2 Before coating | Before coating | 1 | 0.23 | Comparison |
| 18 | O-14 | 33 | 2 Before coating | Before coating | 2 | 0.20 | Comparison |
| 19 | Σ1 | 1 | 2 Before washing | Before washing | 1 | 0.72 | Invention |
| 20 | Σ2 | 1 | 2 Before washing | Before coating | 1 | 0.40 | Comparison |
| 21 | Σ3 | 1 | 2 Before coating | Before washing | 1 | 0.38 | Comparison |
| 22 | Σ4 | 1 | 2 Before coating | Before coating | 1 | 0.30 | Comparison |
| 23 | Σ2 | 1 | 2 Before washing | Not added | 1 | 0.02 | Comparison |
| 24 | Σ4 | 1 | 2 Before coating | Not added | 1 | 0.00 | Comparison |

While the invention has been described in detail and with reference to specific embodiments thereof, it will be apparent to one skilled in the art that various changes and modifications can be made therein without departing from the spirit and scope thereof.

What is claimed is:

1. A method for producing a silver halide emulsion having a silver chloride content of 50 mol % or more and containing silver halide grains in which (111) faces occupy 30% or more of their surface area, wherein said silver halide grains are formed in the presence of at least one compound represented by formula (I), (II) or (III), and a thiocyanate and a sensitizing dye are added prior to a washing step of emulsion production:

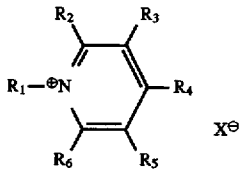

(I)

wherein $R_1$ represents an alkyl group, an alkenyl group or an aralkyl group; $R_2$, $R_3$, $R_4$, $R_5$ and $R_6$ each represents a hydrogen atom or a substituent group; $R_2$ and $R_3$, $R_3$ and $R_4$, $R_4$ and $R_5$ and $R_5$ and $R_6$ may each be cyclocondensed, with the proviso that at least one of $R_2$, $R_3$, $R_4$, $R_5$ and $R_6$ represents an aryl group; and $X^-$ represents a counter anion;

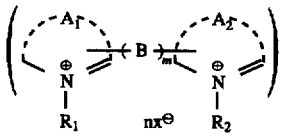

(II)

-continued

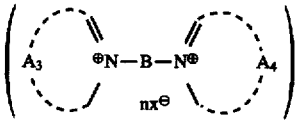

(III)

wherein $A_1$, $A_2$, $A_3$ and $A_4$, which may be the same or different, each represents a nonmetallic atom group for completing a nitrogen-containing heterocyclic ring; B represents a divalent connecting group; m represents 0 or 1; $R_1$ and $R_2$ each represents an alkyl group; X represents an anion; and n represents 0 or 1, and n is 0 in the case of an internal salt.

2. The method as claimed in claim 1, wherein salt desalting is conducted in the washing step using a precipitant containing no sulfonic acid group.

3. The method as claimed in claim 1, wherein the compound represented by formula (I), (II) or (III) is present in an amount of $6\times10^{-5}$ mol or more per mol of silver.

4. The method as claimed in claim 1, wherein the thiocyanate is added in an amount of $1\times10^{-4}$ mol or more per mol of silver.

5. The method as claimed in claim 2, wherein the precipitant contains a carboxylic acid group.

6. The method as claimed in claim 1, wherein said at least one compound is represented by formula (I).

7. The method as claimed in claim 1, wherein said at least one compound is represented by formula (II).

8. The method as claimed in claim 1, wherein said at least one compound is represented by formula (III).

* * * * *